US005669400A

United States Patent [19]

Sheffler et al.

[11] Patent Number: 5,669,400

[45] Date of Patent: Sep. 23, 1997

[54] COSMETIC JAR AND STORAGE DEVICE

[75] Inventors: Robert J. Sheffler, Morganville, N.J.; Charles Chang, 55 Westview Rd., Wayne, N.J. 07470

[73] Assignee: Charles Chang, Wayne, N.J.

[21] Appl. No.: 620,221

[22] Filed: Mar. 22, 1996

[51] Int. Cl.[6] ..... A45D 33/22

[52] U.S. Cl. ..... 132/295; 132/314; 132/317; 132/294; 206/581

[58] Field of Search ..... 132/295, 294, 132/296, 297, 314, 315, 317, 318, 320; 206/581, 823, 536, 537; 401/191, 125

[56] References Cited

U.S. PATENT DOCUMENTS

| | | | |
|---|---|---|---|
| 1,831,885 | 11/1931 | Rogers | 132/314 |
| 3,476,123 | 11/1969 | Flax | 132/315 |
| 3,502,089 | 3/1970 | Paradis | 132/315 |
| 4,777,969 | 10/1988 | Holloway | 132/314 |
| 4,898,195 | 2/1990 | Sussman | 132/317 |

*Primary Examiner*—Gene Mancene
*Assistant Examiner*—Pedro Philogene
*Attorney, Agent, or Firm*—H. Gibner Lehmann; K. Gibner Lehmann

[57] ABSTRACT

A combined cosmetic jar and applicator storage device including a structural body providing a pair of back-to-back shallow recesses for holding cosmetic materials, a removable cover member carried by the body, enclosing one of the recesses to retain cosmetic material therein, and a second cover member carried by the body, enclosing the other of the recesses so as to store a cosmetic applicator therein. The second cover member and body have telescoping portions by which the second cover member is held captive on the body but can shift with respect thereto. Shifting of the second member controls a passage thereof, to permit selective access to the cosmetic applicator stored in the other of the recesses.

22 Claims, 3 Drawing Sheets

COSMETIC JAR AND STORAGE DEVICE

CROSS REFERENCES TO RELATED APPLICATIONS

1. Our co-pending application U.S. Ser. No. 08/558,811 filed Nov. 15, 1995, entitled COSMETIC JAR AND STORAGE DEVICE, and having common ownership with the present application.

STATEMENT AS TO RIGHTS TO INVENTIONS MADE UNDER FEDERALLY SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic dispensers, and more particularly to a class of devices commonly known in the trade as cosmetic "pots", which comprise small jars of varying sizes and which are typically fitted with continuous thread covers and which contain cosmetic substances such as rouges, pressed powders, balms, eyeliner/eyebrow coloring, and the like.

2. Description of the Related Art Including Information Disclosed Under 37 CFR Sections 1.97–1.99

The following references are indicative of some known, cosmetic dispensers of the type to which the present invention relates:

U.S. Pat. Nos.:

| | | |
|---|---|---|
| 2,201,035 | 2,375,027 | 2,534,100 |
| 3,613,697 | 4,777,969 | 5,180,084 |
| 5,348,031 | 5,373,940 | |

PCT Published Application No. WO 87/03179

UK Published Application No. GB 2 152 904A

Several different cosmetic dispenser constructions are disclosed respectively, in U.S. Pat. Nos. 2,201,035; 2,375,027; and 2,534,100. No. '035 illustrates and describes a container having two product-carrying compartments and two brush applicators. No. '027 illustrates an elongated casing having multiple compartments for a cosmetic product, a brush, and a mirror, respectively, whereas U.S. Pat. No. 2,534,100 discloses a more conventional arrangement, involving a drawer-type structure having side-by-side compartments for a cosmetic material and an applicator brush, respectively.

Other constructions are disclosed in U.S. Pat. No. 3,613,697, illustrating an elongate casing having separate compartments, each containing a supply of cosmetic product and an applicator brush.

U.S. Pat. No. 4,777,969 and its counterpart PCT Application No. WO 87/03179, illustrate a twist-to-open cosmetic compact featuring separate compartments to hold a cosmetic substance and an applicator brush, respectively.

A somewhat similar twist-to-open container is shown in UK Published Application No. GB 2 152 904A. Multiple compartments are provided, for holding a plurality of cosmetic substances, respectively. An applicator is also contained in the housing, and is rendered accessible as parts of the housing are turned with respect to one another, to a pre-determined angular position.

Still other cosmetic dispensers are the subjects of U.S. Pat. Nos. 5,180,084 and 5,348,031. U.S. Pat. No. 5,180,084 discloses a dispenser including a product reservoir and pump therefor, and an applicator brush, housed in a tubular casing having a hinged closure member. Patent No. '031 illustrates a combined applicator and storage pan for a cosmetic substance.

Finally, U.S. Pat. No. 5,373,940 discloses a combined lipstick casing and elongate storage canister, for holding coins or other articles. The casing and canister are coaxial with one another, and the latter is shown as being fitted with a continuous thread closure cap.

Other arrangements of known cosmetic dispensers include: 1) variations on the drawer-type noted above, in which a slidable tray is exposed by sliding it out of a protective outer cover or housing; 2) a "stacked" or "double decker" type cosmetic dispenser having a flip-top closure and multiple tray-like structures that are hinged to one another and to the flip-top closure; and 3) a "treasure chest" type dispenser, which resembles a miniature chest of drawers, each drawer having a compartment for cosmetic substance and/or an applicator utensil.

Still another design involves a plurality of miniature jars which are "stacked" one upon another, and where the bottom wall of one jar constitutes a continuous thread lid for a second, and so-forth.

Cosmetic pots as currently manufactured generally take the form of simple, double-walled jars having continuous thread finishes, and fitted with screw caps. The double wall has an advantage in that the exterior of the pot can be made sufficiently large so as to be readily held and manipulated by the fingers, and at the same time providing a reduced-volume storage chamber for the cosmetic substance, which is usually needed in only minute quantities relative to the volume encompassed by the container's outer wall. The disadvantage is that such a double-wall jar can instead, create an undesirable, false impression to consumers. They often misconstrue the use of a double wall container as a purposeful deception on the part of the manufacturer, or a deliberate attempt to misrepresent the actual amount of product being supplied in the container.

While some of the cosmetic dispensers noted above have been commercialized, efforts are continuously under way toward achieving improved economy of manufacture, improved ease of use, and greater consumer appeal.

In particular, one of the problems typically encountered is that of easily storing and protecting the cosmetic applicator, and in a manner that renders the applicator readily accessible, but without disturbing materially, the aesthetics of the overall product.

Also, consideration must be given to adequate isolation of the applicator when not in use, to minimize inadvertent contamination. In particular, special care is required while applying cosmetic material to the face, especially to areas around the eyes, as in the case of eyelid liner and eyebrow liner. The issue of avoiding possible contamination of a product or applicator brush used therewith is an important factor which must be addressed, in the production and distribution of any cosmetic dispenser.

A related consideration is that of avoiding inadvertent spillage of the dispenser contents, which might otherwise lead to soiling of clothing or furniture. Ease of manipulation and use of the applicator is also important, thereby reducing the possibility of its being inadvertently dropped by the consumer.

SUMMARY

Accordingly, it is one object of the present invention to provide improved cosmetic jar and storage devices which are simple in structure and at the same time convenient to use, retaining essentially the same, familiar look and feel of a conventional cosmetic jar or "pot" of the type currently in widespread use.

A related object of the invention is to provide improved cosmetic jar and storage devices as above set forth, which feature improved resistance to inadvertent contamination of the jar contents and applicator therefor, and less tendency for inadvertent soiling of clothing from accidental contact with the applicator.

Still another object of the invention is to provide improved cosmetic jar and storage devices as above characterized, which are constituted of relatively few separate components that can be readily molded in simple mold cavities, so as to keep the manufacturing cost as low as possible.

Yet another object of the invention is to provide improved cosmetic jar and storage devices of the kind indicated, which are especially easy for the consumer to manipulate and use, thereby enhancing their marketability or commercialization.

A still further object of the invention is to provide improved cosmetic jar and storage devices in accordance with the foregoing, which are aesthetically pleasing in appearance, again enhancing their overall eye-appeal and marketability.

The above objects are accomplished, in one embodiment of the invention, by a combined cosmetic jar and applicator storage device comprising in combination, a structural body providing a pair of back-to-back shallow recesses for holding cosmetic materials, removable cover means carried by the body and enclosing one of the recesses to retain a cosmetic material therein, and a second cover means carried by and cooperable with the body, enclosing the other of the recesses to retain a cosmetic applicator therein. The second cover means and body have telescoping portions by which the second cover means is continuously attached to and held by the body. The second cover means includes a frame portion defining a passage through which the cosmetic applicator can be inserted into the other of the recesses and removed therefrom. At least a portion of the second cover means is movable with respect to the body, and cooperable therewith to either close or else open the passage defined by its frame portion.

The arrangement is such that in each case, the applicator, when stored, is maintained in a closed compartment which is separate and apart from that of the cosmetic substance. The applicator can be readily accessed by the consumer, by a relatively simple procedure involving pulling downward on the cover means to expose the passage therein; or as an alternative, twisting the cover means with respect to the body, to thereby expose an access passage in the lower recess, which carries the applicator.

Following use, the applicator can be readily replaced, and the combined cosmetic jar and applicator storage device returned to its normal, closed position.

The jar and applicator storage devices feature few separate components, all of which can be economically molded. Thereafter the parts can be easily assembled, and the jars filled with the intended cosmetic product or substance. Introduction of the applicator utensil into its own compartment is similarly readily accomplished.

As a consequence, highly functional and aesthetically pleasing cosmetic dispensers are realized, with low overall manufacturing cost, and use of minimal quantities of plastic raw material.

Other features and advantages will hereinafter appear.

BRIEF DESCRIPTION OF THE DRAWINGS

In the drawings, illustrating several embodiments of the invention.

DESCRIPTION OF THE PREFERRED EMBODIMENTS

Figure 1:
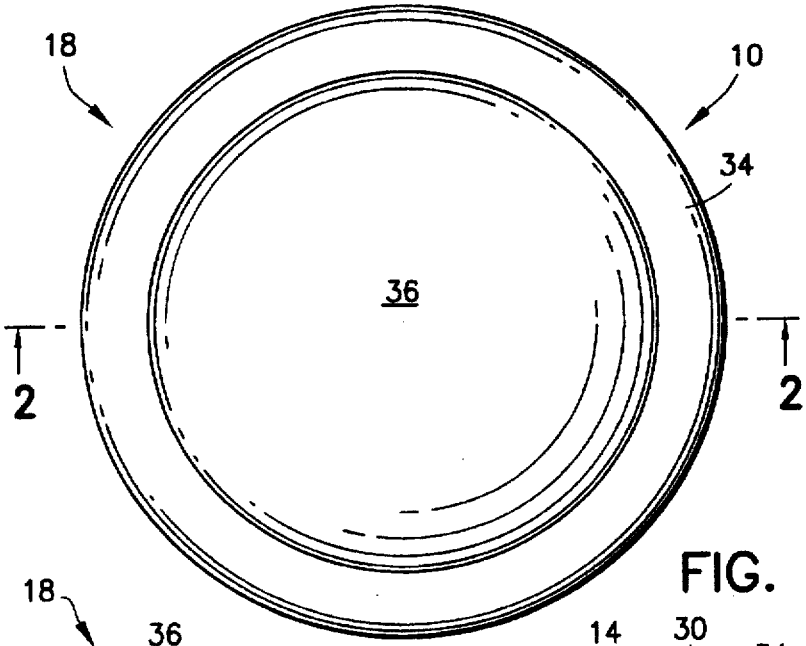
FIG. 1 is top plan view of an improved cosmetic jar and applicator storage device constructed in accordance with the principles of the present invention.

Referring first to FIGS. 1–3, 5 and 7, and in accordance with the present invention there is provided a novel and improved cosmetic jar and applicator storage device generally designated by the numeral 10, comprising a structural body 12 of generally cylindrical configuration, having a pair of back-to-back shallow recesses 14, 16 which are covered respectively by a removable cover means 18 and a slide cover means 20. The recess 14 is adapted to carry a quantity of cosmetic material or substance (not shown) and the recess 16 is intended to accommodate a cosmetic applicator 22 of a type such as the brush shown in FIG. 8.

Figure 2:
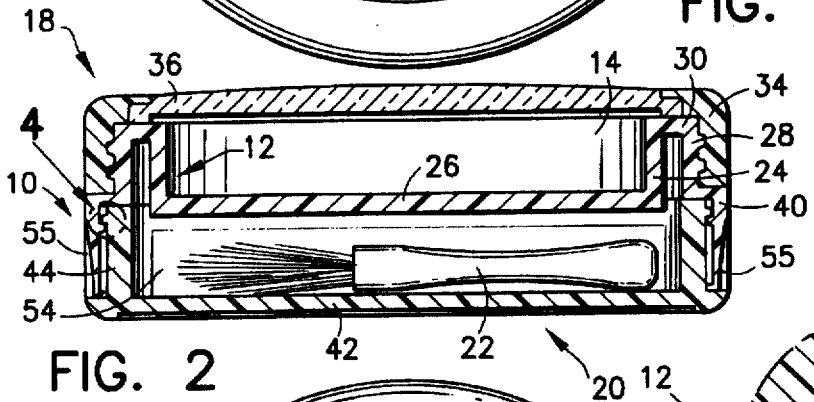
FIG. 2 is an axial section of the jar and storage device taken on the line 2—2 of FIG. 1, and particularly illustrating first and second removable cover means for enclosing two back-to-back recesses respectively, of the device.
Figure 14:
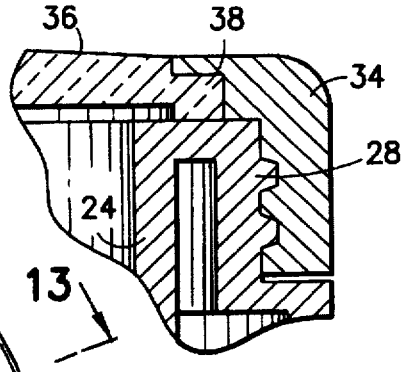
FIG. 14 is a detail view, greatly enlarged, of a cover means for the upper recess of the embodiment of FIGS. 1–3; or that of FIGS. 9 and 10; or that of FIGS. 11–13.

The upper recess 14 is defined by an annular or circular side wall 24 and a transverse bottom wall 26. An additional or outer annular wall 28 is joined to the wall 24 by an integral web 30 whereby the walls 24 and 28 together with the web 30 form an inverted U-section rim. On the exterior or outer periphery of the wall 28 is a continuous thread 32 adapted to mate with a cooperable continuous thread on the cover means 18 which in the present case is a screw cap or threaded closure member. The closure member 18 comprises an annular rim portion 34 and a central circular lens or face member 36 of transparent or semi-transparent material as shown in FIGS. 2 and 14, thereby enabling the cosmetic product in the upper recess 14 to be viewed from the exterior, with the cover means 18 closed. The lens 36 has an integral, axially-offset rim portion 38, FIG. 14, which underlies and nests in the inner periphery of the annular rim portion 34 to form a unitary assemblage.

The lower recess 16 of the body 12 is formed by a depending annular wall or skirt 40, and the transverse wall 26 is seen to be common to both recesses 14 and 16. As mentioned above, the lower recess 16 along with its cover means 20 defines the applicator storage compartment.

Figure 4:
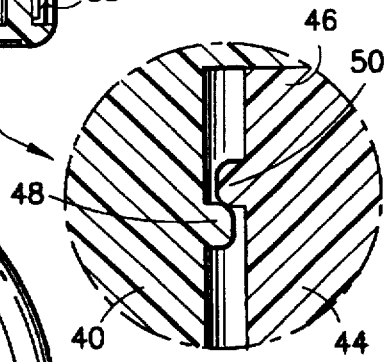
FIG. 4 is a detail view, greatly enlarged, of the area designated by the numeral 4 of FIG. 2.
Figure 3:
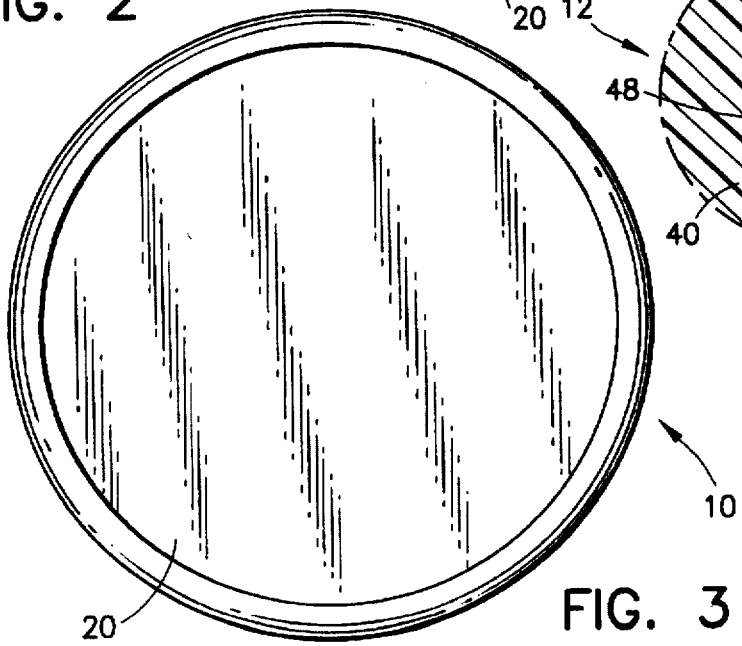
FIG. 3 is a bottom plan view of the cosmetic jar and applicator storage device of FIGS. 1 and 2.

As provided by the present invention and as shown in FIGS. 2, 3, 5 and 7, the second or lower cover means 20 for the recess 16 is in the form of a tray having a transverse bottom wall 42, and a frame portion in the form of a cylindrical side wall 44. The side wall or frame portion 44 has a continuous top rim 46, which is telescopically received in the annular skirt 40 of the body 12, with a sliding fit. The side wall 44 and annular skirt 40 have cooperable detent means in the form of annular beads 48, 50, and 52, FIGS. 4 and 6, the beads 48, 50 functioning to provide a detent for the tray when it is in its raised, closed position as in FIGS. 2 and 4. The beads 50 and 52 provide a positive detent or stop when the tray 20 is disposed in its lowered, open position, thereby to retain it against inadvertent removal from the body 12. In practice, the beads 48 and 50 can be forcibly by-passed during opening of the lower recess 16, whereas the beads 50 and 52 are strictly for retentive purposes, and are not intended to bypass one another following the initial assembly of the device.

Figure 8:
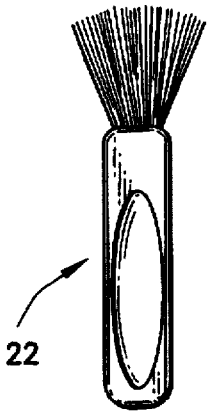
FIG. 8 is a plan view of an applicator brush as employed with the jar and storage devices of the present invention.
Figure 5:
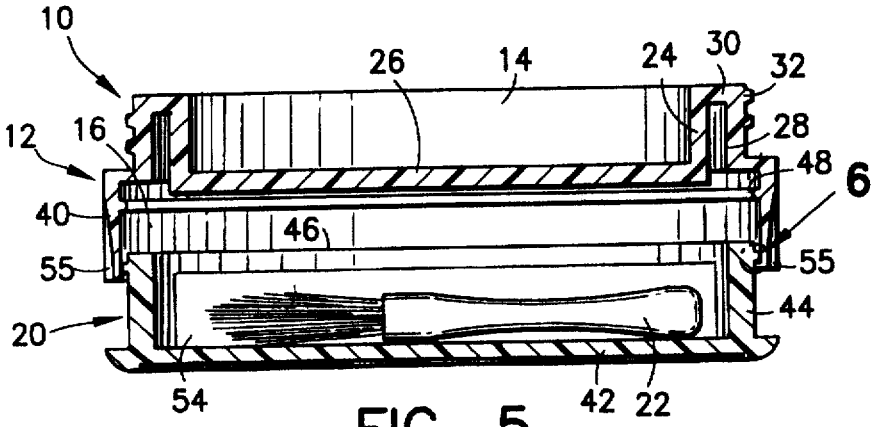
FIG. 5 is an axial section like FIG. 2, except showing the second cover means of the jar and storage device disposed in a fully open position, so as to provide access to an applicator contained therein.
Figure 6:
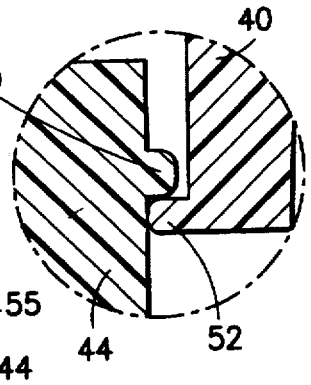
FIG. 6 is a detail view, greatly enlarged, of the area designated by the numeral 6 of FIG. 5.
Figure 7:
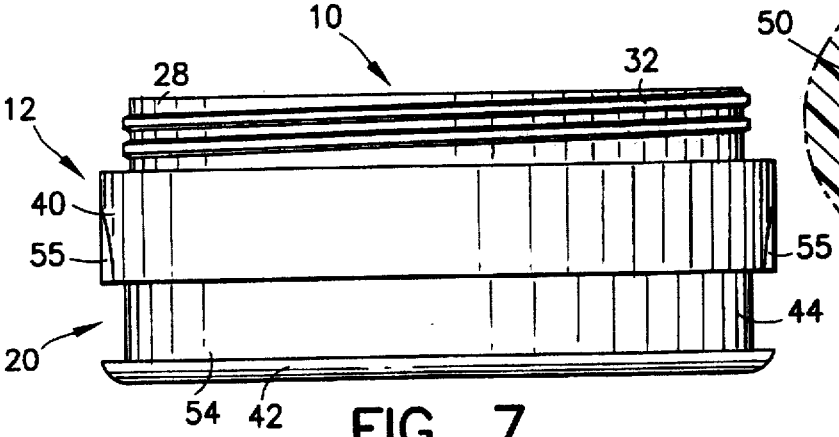
FIG. 7 is a side elevational view of the cosmetic jar and applicator storage device of FIGS. 1–3 and 5, with the second cover means fully open as in FIG. 5, but with the access passage thereof disposed at the rear and thus being hidden from view.

By the invention, the side wall or frame portion 44 of the tray 20 has a window-like cutout 54 forming an elongate passage extending circumferentially through an angle preferably greater than 90 degrees, the passage being visible and accessible only when the tray 20 is lowered as in FIGS. 2, 5 and 7. The applicator 22 can be readily removed from the tray 20 through this passage 54, and re-inserted therein following use, for storage. Aside from the applicator 22 shown in FIG. 8, illustrating a molded plastic handle and a brush, other applicators can also be used, including flocked sponge or velour types, depending on the nature of the cosmetic material being dispensed.

With the disclosed arrangement, the contents of the jar 10 are maintained separated from the applicator 22 when the latter is being stored. During such storage the applicator 22 is isolated from inadvertent contamination, as well as being confined so as to minimize any tendency for contact with clothing, furniture, handling contents, etc. Access to the recess 16 containing the applicator is advantageously gained by a simple downward "pull" operation on the tray 20, readily exerted by the fingers of the user. Small notches or reliefs 55 in the outer surface of the skirt 40, shown in FIG. 2, facilitate grasping the underlying edge of the tray 20. An extremely simple yet highly functional cosmetic dispenser package is thus realized.

Figure 9:
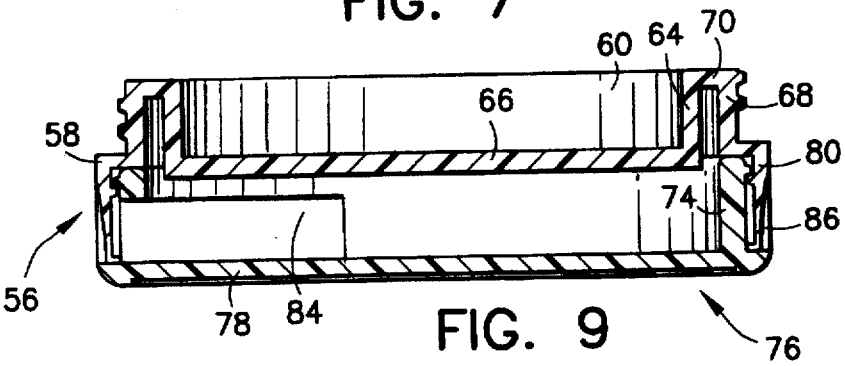
FIG. 9 is an axial section, similar to that of FIG. 2, illustrating a modified cosmetic jar and applicator storage device which incorporates a twist-to-open cover means for the lower recess, constituting another embodiment of the invention.
Figure 10:
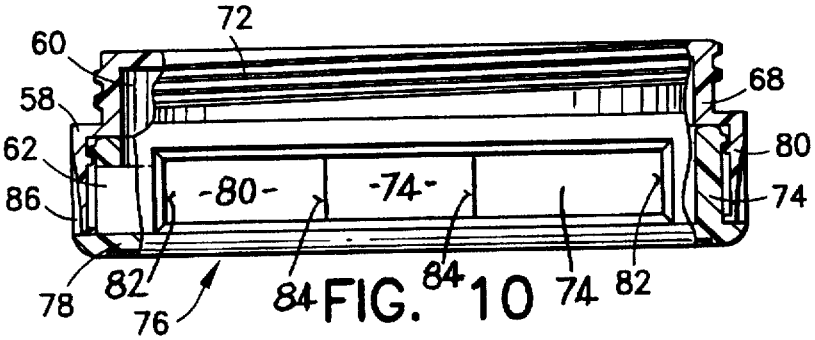
FIG. 10 is a view partly in side elevation and partly in section, of the cosmetic jar and applicator storage device of FIG. 9, showing the lower recess in a partially open condition, for accessing the applicator device.

Another embodiment of the invention is illustrated in FIGS. 9 and 10, showing a modified cosmetic jar and applicator storage device 56. This modified construction comprises a generally cylindrical body 58 having a pair of back-to-back shallow recesses 60, 62 similar to those of the embodiment of FIGS. 1–3, 5 and 7. The upper recess 60 is defined by a circular side wall 64 and a transverse bottom wall 66. An outer annular wall 68 joins the wall 64 at an integrally formed rim or web 70. A continuous thread 72 on the outer wall 68 mates with a cooperable continuous thread on the respective cover means or screw cap, as in the first embodiment.

The lower recess 62 receives an annular peripheral wall 74 which constitutes a frame portion of a tray 76 that acts as a cover means for the lower recess 62. The transverse wall 66 is common to both recesses 60 and 62. The lower recess 62 along with its cover means or tray 76, defines the applicator storage compartment.

The tray 76 has a transverse bottom wall 78, and its cylindrical frame portion or side wall 74 is telescopically received in an annular depending skirt 80 of the body 58, with a sliding fit. The side wall 74 and annular skirt 80 have cooperable retainer means comprising retainer beads as shown.

By the invention, the depending skirt 80 of the body 58 and the frame portion or side wall 74 of the tray 76 have elongate windows or passages defined by end edges 82, 84 respectively, the windows extending circumferentially through angles preferably greater than 90 degrees. The tray 76 can be manually turned with respect to the body 58, so as to render the passages either in registration with one another, or else out of registration with one another. In practice, the tray 76 can be free to turn in the skirt 80, since circumferential stops or detents are not essential to the proper functioning of the storage mode of the device.

With the passages in registration, access to the lower recess 62 is exposed, permitting withdrawal of the applicator and subsequent insertion thereof, following use. Turning of the tray 76 through an angle on the order or 180 degrees can bring both passages fully out of registration with one another, thereby closing off the lower recess 62 and providing a storage function for the applicator.

The retainer beads on the walls 74 and 80 are such as to permit an initial by-pass during assembly of the tray 76 to the body 58, but to resist separation thereafter. With a suitable sliding fit, turning of the tray 76 so as to open or close the recess 62 can be readily accomplished. Also, finger-engageable shoulders 86 are preferably provided in the outer surface of the skirt 80 to facilitate such turning.

The disclosed construction enjoys the advantage of a simple twist-to-open operation, with no possibility of tilting or canting of the tray, since the engagement of the beads retains the tray in full telescoping relation to the body. Access can be gained by turning of the tray in either of opposite directions, until the passages register with one another to the extent necessary to access the applicator. Re-insertion of the same and closure of the recess or compartment is readily accomplished, with a minimum of time and effort.

The advantages noted above in connection with isolation and freedom from contamination are retained in the present embodiment.

Figure 11:
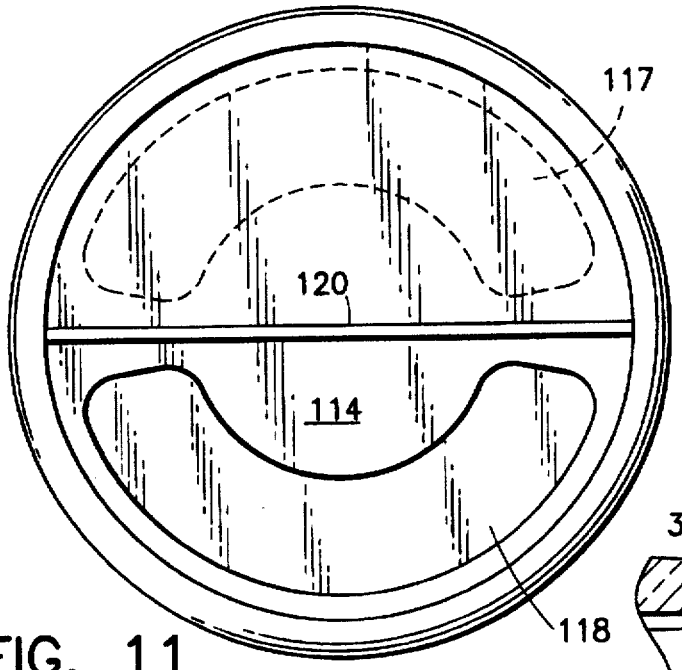
FIG. 11 is a bottom plan view of a further embodiment of cosmetic jar and applicator storage device, incorporating a modified twist-to-open cover means for the lower recess.
Figure 12:
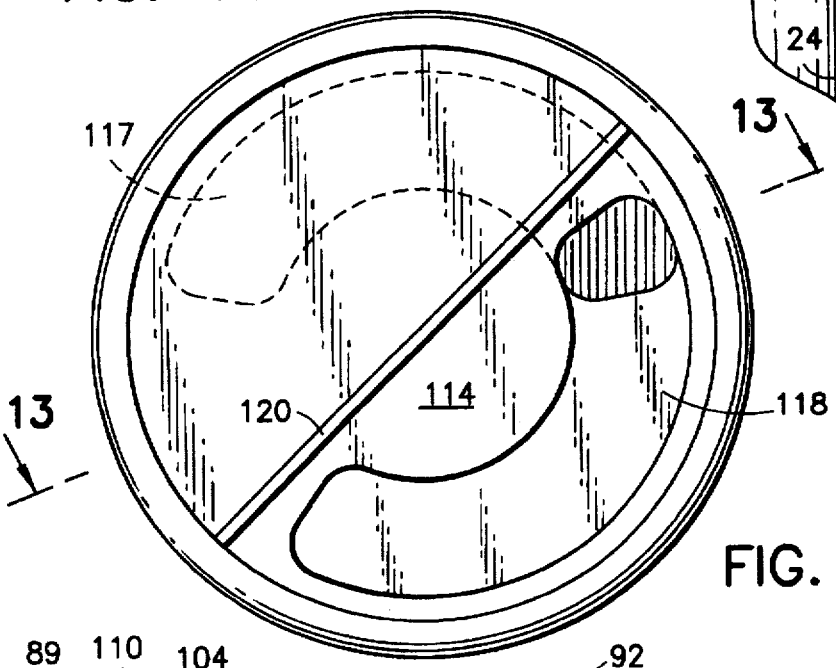
FIG. 12 is a view like that of FIG. 11, except showing the cover means for the lower recess having been twisted toward a partially opened position.
Figure 13:
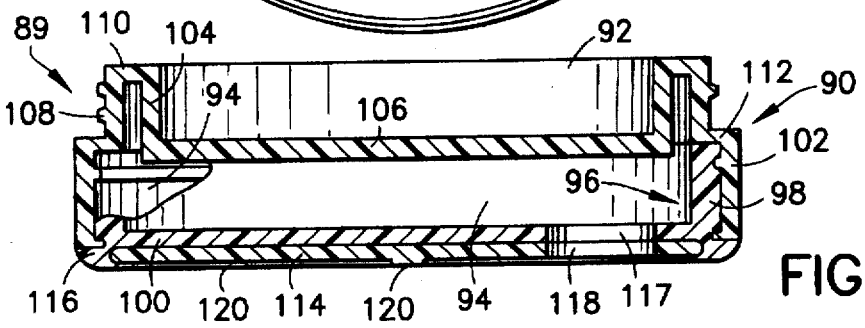
FIG. 13 is an axial section taken on the line 13—13 of FIG. 12.

Still another embodiment of the invention is illustrated in FIGS. 11–13, constituting a further modified cosmetic jar and applicator storage device. In these figures the storage device 89 comprises a structural body 90 defining back-to-back shallow recesses 92 and 94, the upper recess 92 corresponding to the recess 14 of the embodiment of FIG. 2, which is closed by the removable cover 18.

The lower recess 94 of the body component 90 is similar in many respects to the lower recess 16 of FIG. 5, but it is closed by a pressed in, fixed telescoped closure cup 96 comprising an annular side wall 98 and a circular bottom wall 100. The cup 96 is telescopically received in an annular skirt 102 of the body 90, and secured in place by cooperable annular retainer beads as shown. The upper recess 92 is formed by an annular wall 104 and transverse bottom wall 106. The upper portion of the body 90 has an outer annular wall 108 which is joined to the wall 104 by a web portion 110, and joined to the skirt 102 by a shoulder 112.

The overall jar 89 has, in addition to the fixed bottom wall 100, a closure means constituted as a rotary bottom wall or shutter 114. The wall or shutter 114 has a frame portion defining an opening, and is in the form of an apertured flat disk that is received in a saucer-shaped recess formed by an undercut bottom flange 116 of the wall 98, so as to be superposed with the wall 100. The walls 100 and 114 respectively have curved, sausage-shaped, off-center or off-set slots 117 and 118 in them, which can be brought into registration by turning the wall 114, and for this purpose the wall 114 has a diametric rib 120 which can be engaged by the user's fingers so as to enable it to be easily turned with respect to the body 90.

Referring to FIGS. 11–13, the slots 117 and 118 can be aligned or brought into registration with one another to gain access to the lower recess 94 where the applicator is stored. Following use, the applicator is re-inserted through the registered apertures, and the shutter 114 thereafter turned typically through one-half a turn, so as to re-orient the slots 117, 118 and bring them out of registration. Under such circumstance, the lower recess 94 is completely closed off, and the applicator effectively isolated in its own storage chamber. Thus, the advantages noted above in connection with isolation and freedom from contamination are preserved, with the construction of the present embodiment.

The arcuate shapes of the slots 117, 118 as shown in FIGS. 11 and 12 are considered exemplary, although deviations from the exact configurations depicted may be satisfactory for some applications, depending to a large extent on the size and shape of the particular applicator or appliance being stored. Possible variations in both size and shape are contemplated, within the scope of the present invention.

Unlike the embodiment of FIGS. 9 and 10, where the tray was rotatable on the body, with the present construction of FIGS. 11–13, the cup 96 is held fixed and non-rotating on the body 90. Instead, the disk 114 is turnable in the flange 116, so as to control the position of the slot 118 therein with respect to the slot 117, as can be readily understood.

From the above it can be seen that we have provided novel and improved cosmetic jar and applicator storage devices which feature simplicity, economy and improved function.

The individual components can be readily molded and assembled, so as to keep the fabrication cost low. The jar is characterized by a flat, disk-like external appearance, which is in keeping with the general configuration of known cosmetic dispensers, aside from the unusual, eye-catching appearance of several of the jars as they are being used.

The devices are thus seen to represent a distinct advance and improvement in the field of cosmetic dispensers.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

What is claimed is:

1. A combined cosmetic jar and applicator storage device comprising, in combination:

a) a structural body providing a pair of back-to-back shallow recesses having top edges, said recesses being adapted for holding cosmetic materials, b) removable cover means carried by said body, enclosing one of said recesses to retain cosmetic material therein, and c) a second cover means carried by and cooperable with said body, enclosing the other of said recesses to retain a cosmetic applicator therein, d) said second cover means and body having telescoping portions by which said second cover means is continuously attached to and held by said body, e) said second cover means including a frame portion defining a passage through which said cosmetic applicator can be inserted into the other of said recesses and removed therefrom, f) at least a portion of said second cover means being movable with respect to said body and cooperable therewith to either close or else open the said passage defined by said frame portion.

2. A combined cosmetic jar and storage device as set forth in claim 1, wherein:

a) the telescoping portions of the body and the second cover means enable the latter to be shifted between a raised, closed position contained within the body and a lowered, open position wherein the second cover means locates the said passage of the frame portion so that said passage is exteriorly exposed, thereby to provide access to the other of the said recesses of the body.

3. A combined cosmetic jar and storage device as set forth in claim 2, wherein:

a) the second cover means comprises a shallow tray having a side wall, b) said passage of the frame portion of the second cover means being located in said side wall.

4. A combined cosmetic jar and storage device as set forth in claim 2, wherein:

a) the second cover means comprises a shallow tray having a side wall provided with a continuous top rim that is contained in the said body.

5. A combined cosmetic jar and storage device as set forth in claim 3, wherein:

a) the side wall of the second cover means is cylindrical, b) said body having a cylindrical wall in which the side wall of the second cover means rotatably fits and in which said second cover means is freely turnable.

6. A combined cosmetic jar and storage device as set forth in claim 2, wherein:

a) the telescoping portions of the body and second cover means have cooperable yieldable detent devices which hold the second cover means in a raised, closed position in the body.

7. A combined cosmetic jar and storage device as set forth in claim 2, wherein:

a) the telescoping portions of the body and second cover means have cooperable detent devices which hold captive the cover means when said second cover means is in its lowered, open position.

8. A combined cosmetic jar and storage device as set forth in claim 1, wherein:

a) the body has a U-section rim which defines the top edge of the said one of the back-to-back recesses.

9. A combined cosmetic jar and storage device as set forth in claim 1, wherein:

a) the body and second cover means have telescopic cylindrical walls fitting one into the other, b) said second cover means being turnable with respect to the body, c) said cylindrical walls having passages which can be aligned with each other to provide access to the other of the recesses or else misaligned with each other to close the other recess.

10. A combined cosmetic jar and storage device as set forth in claim 9, wherein:

a) the said passages extend circumferentially a distance greater than the passages extend axially.

11. A combined cosmetic jar and storage device as set forth in claim 10, wherein:

a) the passages extend circumferentially through an arc of more than 90 degrees.

12. A combined cosmetic jar and storage device as set forth in claim 9, wherein:

a) detent means are provided to retain the second cover means in the body irrespective of the relative rotative positions of the second cover means and body.

13. A combined cosmetic jar and storage device as set forth in claim 1, wherein:

a) the body and second cover means have telescopic cylindrical walls fitting one into the other, b) said second cover means having two superposed bottom walls the lower bottom wall being turnable with respect to the upper bottom wall, c) said bottom walls having openings which can be registered with each other to provide a passage giving access to the other of said recesses, or which can be misaligned to close off the said other recess.

14. A combined cosmetic jar and storage device as set forth in claim 13, wherein:

a) the openings in said bottom walls are offset from the center portions of the bottom walls.

15. A combined cosmetic jar and storage device as set forth in claim 14, wherein:

a) the said openings in the superposed bottom walls are sausage-shaped.

16. A combined cosmetic jar and storage device as set forth in claim 13, wherein:

a) the lower bottom wall has a diametric rib providing a finger grip to enable a user to turn said lower bottom wall.

17. A combined cosmetic jar and storage device as set forth in claim 15, wherein:

a) the lower bottom wall has a diametric rib spanning the sausage-shaped opening thereof and providing a finger grip to enable a user to turn said lower wall.

18. A combined cosmetic jar and storage device as set forth in claim 13, wherein:

a) the upper bottom wall of the second cover means has a saucer-shaped recess, b) said lower bottom wall being disposed in the said saucer-shaped recess, c) said second cover means having a rim portion provided with an annular flange which overlies the lower bottom wall and holds the latter captive.

19. A combined cosmetic jar and storage device as set forth in claim 2, wherein:

a) the telescoping portions of the second cover means and the body are press-fitted to each other.

20. A combined cosmetic jar and storage device as set forth in claim 19, wherein:

a) the telescoping portions of the second cover means and body comprise partial portions of cylinders.

21. A combined cosmetic jar and storage device as set forth in claim 19, wherein:

a) said second cover means and body have cooperable detents to prevent their separation.

22. A combined cosmetic jar and storage device as set forth in claim 1, wherein:

a) said removable cover means comprises an annular molded plastic rim member and a molded plastic circular face member press-fitted into said rim member having an inner periphery, b) said face member having a transparent circular center portion and an integral, axially-offset rim portion which latter underlies the inner periphery of the said annular rim member.

* * * * *